US006925426B1

(12) United States Patent
Hartmann

(10) Patent No.: US 6,925,426 B1
(45) Date of Patent: Aug. 2, 2005

(54) PROCESS FOR HIGH FIDELITY SOUND RECORDING AND REPRODUCTION OF MUSICAL SOUND

(75) Inventor: William M. Hartmann, East Lansing, MI (US)

(73) Assignee: Board of Trustees operating Michigan State University, East Lansing, MI (US)

( * ) Notice: Subject to any disclaimer, the term of this patent is extended or adjusted under 35 U.S.C. 154(b) by 0 days.

(21) Appl. No.: 09/510,629

(22) Filed: Feb. 22, 2000

(51) Int. Cl.[7] ..... G06G 7/56
(52) U.S. Cl. ..... 703/5; 381/1; 381/98
(58) Field of Search ..... 703/5; 381/1, 98; 84/631; 369/86

(56) References Cited

U.S. PATENT DOCUMENTS

| | | | | |
|---|---|---|---|---|
| 2,806,953 A | * | 9/1957 | Krauss | 331/61 |
| 3,362,886 A | | 1/1968 | Chauncey | |
| 3,708,631 A | | 1/1973 | Bauer et al. | |
| 3,829,615 A | | 8/1974 | Hiramatsu | |
| 3,942,190 A | | 3/1976 | Detwiler | |
| 4,074,084 A | | 2/1978 | Van den Berg | |
| 4,175,466 A | * | 11/1979 | Aronis | 84/288 |
| 4,176,252 A | | 11/1979 | Dutkovich | |
| 4,309,570 A | | 1/1982 | Carver | |
| 4,382,157 A | | 5/1983 | Wert, Jr. | |
| 4,604,687 A | | 8/1986 | Abbott | |
| 4,807,217 A | | 2/1989 | Ide | |
| 4,847,816 A | | 7/1989 | Kawahara et al. | |
| 4,965,674 A | | 10/1990 | Nagasawa et al. | |
| 5,162,922 A | | 11/1992 | Takemura et al. | |
| 5,197,047 A | | 3/1993 | Witheridge et al. | |
| 5,206,913 A | * | 4/1993 | Sims | 381/103 |
| 5,323,273 A | | 6/1994 | Azuma et al. | |
| 5,481,518 A | | 1/1996 | Kashida et al. | |
| 5,517,672 A | | 5/1996 | Reussner et al. | |
| 5,555,230 A | | 9/1996 | Kashida et al. | |
| 5,590,094 A | | 12/1996 | Inanaga et al. | |
| 5,590,100 A | | 12/1996 | Ogusu et al. | |
| 6,279,379 B1 | * | 8/2001 | Logue et al. | 73/24.01 |
| 6,526,849 B1 | * | 3/2003 | Ishikawa | 74/640 |

OTHER PUBLICATIONS

The Computer Science and Engineering Handbook, by Allen B. Tucker, CRC Press, ISBN: 0–8493–2909–4, 1996, pp. 1354–1360.*

The Computer Science and Engineering Handbook, by Allen B. Tucker, CRC Press, ISBN: 0–8493–2909–4, 1996, pp. 1557–1559.*

Illustrated Oxford Dictionary, Oxford University Press, 1998, ISBN 0–7894–3557–8, pp. 270 and 667.*

Meyer, Jurgen, "Acoustics and the Performance of Music", (1978), pp. 88–98;141–150.

* cited by examiner

*Primary Examiner*—Kevin J. Teska
*Assistant Examiner*—Eduardo Garcia-Otero
(74) *Attorney, Agent, or Firm*—Harness, Dickey & Pierce, P.L.C.

(57) ABSTRACT

A local performance simulation system simulates an ensemble sound pattern. The simulation system includes a signal generation system for simultaneously generating contact recording signals based on vibrations from the ensemble, where the ensemble produces an ensemble sound pattern. A signal processing system channelizes the contact recording signals and generates final instrument signals based on the channelized contact recording signals. The simulation system further includes a reproduction system with dedicated loudspeaker systems for generating audible sound waves based on the final instrument signals, where the sound waves simulate the ensemble sound pattern. Contact recording the vibrations and channelizing the contact recording signals eliminates all reverberation and reflection effects of the recording environment from the contact recording signals. Using a dedicated loudspeaker system for each instrument in the ensemble allows the simulation system to capture the reflection and reverberation effects of the listening environment, and creates the impression that the ensemble is present in the listening environment.

14 Claims, 7 Drawing Sheets

PROCESS FOR HIGH FIDELITY SOUND RECORDING AND REPRODUCTION OF MUSICAL SOUND

BACKGROUND OF THE INVENTION

1. Field of the Invention

The present invention relates generally to sound recording and reproduction systems. More particularly, the present invention relates to local performance simulation.

2. Discussion of the Related Art

Sound recording and reproduction has long been the subject of research, development and debate. Conventional stereophonic practices create a musical environment for the listener by including recording environment information, specifically early reflections and reverberation. Recording engineers therefore pay close attention to the recording hall and the location of the microphones when they record ensembles. When the original recording has inadequate environment information, such information is typically added artificially through electronic reverb boxes and ambience synthesizers. Artificial addition is essential when the original recording is made electronically or by tight-miking techniques.

The value of replacing recording environment effects with the actual effects of the listing environment, therefore, have largely gone overlooked. There are many circumstances, however, in which it is quite desirable to simulate a "local performance." For example, there is a small but significant market of classical music connoisseurs who would greatly value the experience of a string quartet playing in the comfort of their own homes. Another benefit of local performance simulation is the possibility of elimination of intermodulation (IM) distortion between the tones of different instruments. Because the tones of a musical instrument tend to be harmonic, local performance simulation would limit distortion to harmonic distortion only, causing only a slight change in coloration for the instrument.

It is also desirable to provide the ability to highlight a particular musical instrument in an ensemble for educational purposes. Similarly, local performance simulation would allow the tone color of each instrument to be varied to taste. For instance, when listening to a simulated quartet, the listener could elect to give the second violin a darker tone color to exaggerate the difference between it and the first violin. There is also a need to individually shut off any instrument of the ensemble to provide a "music-minus-n" system. The local performance technique would allow the performer to feel that the other musicians of the ensemble are with her and around her, in the same listening environment. Furthermore, because each instrument would be recorded separately, editing of recordings and processing of individual voices would be facilitated. Errors by one musician could be corrected without the participation of the other musicians. It is also desirable to optimize loudspeakers for their particular functions. This would eliminate the present need, for example, for a large low-frequency driver (woofer) in the system that is dedicated to a flute. Dedicating loudspeaker systems would therefore control the cost of multichannel ensembles.

Present stereophonic practice sometimes attempts to localize sound images, but localization is psychoacoustically fragile. This means that present audio imaging approaches depend on the loudspeakers, listening environment, and listener position used by the ultimate consumer. Adding to the difficulty is the fact that the principle function of stereo is to de-localize the sounds from the loudspeaker positions themselves and to provide a broadened image. In other words, stereophonic recording by definition attempts to bring the listener into the recording environment instead of bringing the musical performance into the listening environment. Furthermore, conventional stereophonic sound reproduction and contemporary surround sound techniques require the listener to be in a particular place or area. It is thus desirable to provide a sound recording and reproduction system with accurate imaging capability. This capability would allow the listener to perceive the individual instruments or voices to be spatially compact, and well-localized in azimuth, elevation and distance. Furthermore, it would be desirable to allow the listener to walk entirely around the synthesized performing ensemble.

SUMMARY OF THE INVENTION

In view of the above, a need exists for a system capable of accurately simulating the radiation pattern of each instrument in an ensemble. Accordingly, the present invention provides a method and system for simulating an ensemble sound pattern. The local performance simulation system includes a signal generation system for simultaneously generating contact recording signals based on vibrations from an ensemble, where the ensemble produces an audible ensemble sound pattern. A signal processing system channelizes the contact recording signals and generates final instrument signals based on the channelized contact recording signals. The simulation system further includes a reproduction system for generating audible sound waves based on the final instrument signals, where the sound waves simulate the ensemble sound pattern.

Thus, the method includes the steps of simultaneously generating contact recording signals based on vibrations from the ensemble, where the ensemble produces an audible ensemble sound pattern. The contact recording signals are channelized, and final instrument signals are generated based on the channelized contact recording signals. The method further provides for generating audible sound waves with a reproduction system based on the final instrument signals, where the sound waves simulate the ensemble sound pattern.

In another aspect of the invention, a method for tuning a local performance simulation system is provided. The tuning method includes the steps of matching a system overall frequency response to a known overall frequency response, and matching a system coarse asymmetrical frequency response to a known coarse asymmetrical frequency response. A system fine asymmetrical frequency response is further matched to a known fine asymmetrical frequency response. The system overall frequency response, system coarse asymmetrical frequency response and system fine asymmetrical frequency response simulate a frequency response of an audible ensemble sound pattern produced by an ensemble.

Further objects, features and advantages of the invention will become apparent from a consideration of the following description and the appended claims when taken in connection with the accompanying drawings.

BRIEF DESCRIPTION OF THE DRAWINGS

The objects and feature of this invention will become further apparent from a reading of the following detailed description taken in conjunction with the drawings, in which.

DETAILED DESCRIPTION OF THE PREFERRED EMBODIMENT

Figure 1:
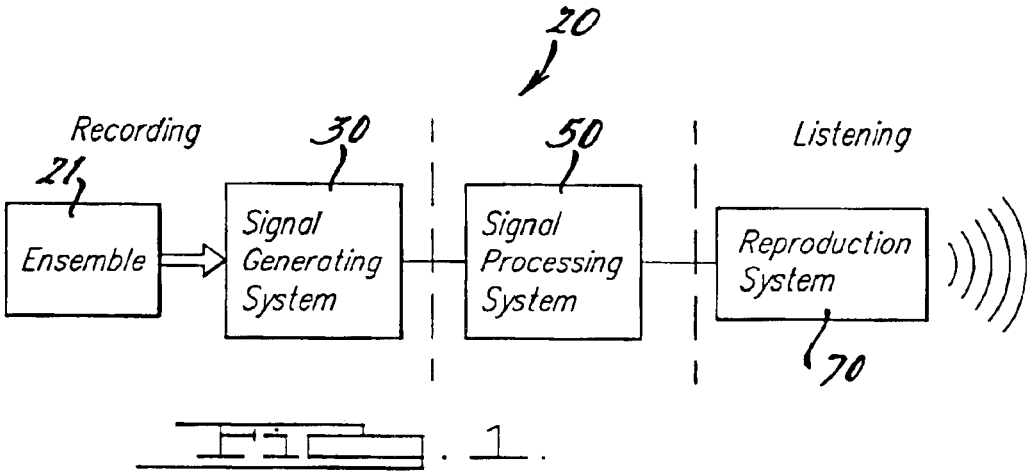
FIG. 1 is a block diagram of a local performance simulation system according to the preferred embodiment of the present invention.

As illustrated in FIG. 1, a local performance simulation system 20 simulates an ensemble sound pattern by producing sound waves which simulate the ensemble sound pattern. The simulation system 20 has a signal generation system 30, a signal processing system 50, and a reproduction system 70. The signal generation system 30 simultaneously generates contact recording signals based on vibrations from an ensemble 21, where the ensemble 21 produces an audible ensemble sound pattern. The signal processing system 50 channelizes the contact recording signals and generates final instrument signals based on the channelized contact recording signals. The simulation system 20 further includes a reproduction system 70 for generating audible sound waves based on the final instrument signals, where the sound waves simulate the ensemble sound pattern. The reproduction system 70 therefore uses the reflection and reverberation effects of the listening environment to create the perception that the ensemble 21 is present and that the ensemble sound pattern is being generated from within the listening environment.

Figure 3:
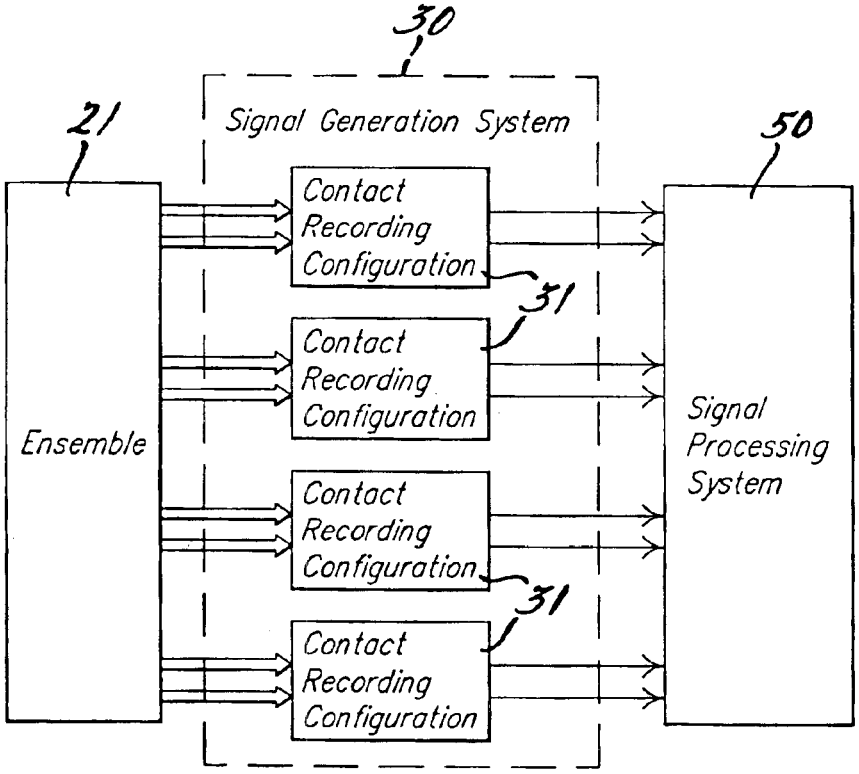
FIG. 3 is a block diagram of a signal generation system according to the present invention.
Figure 2:
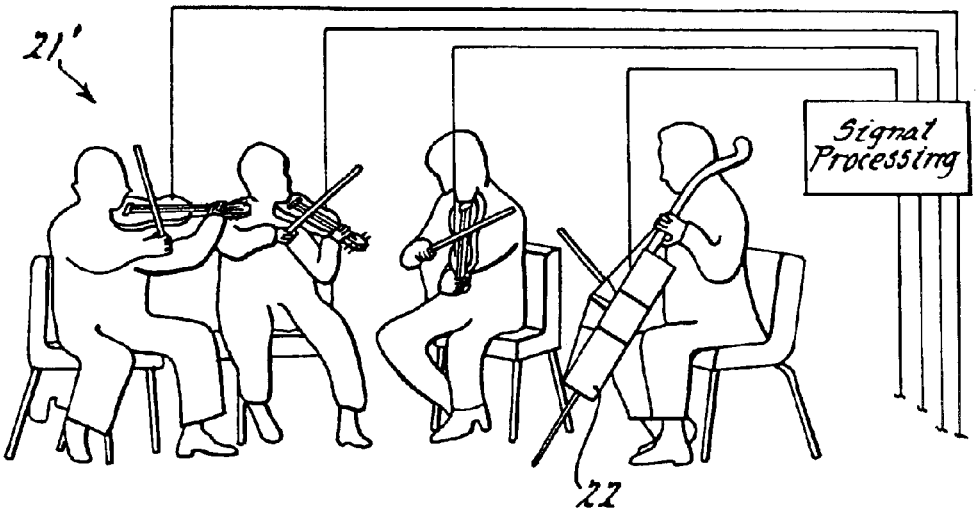
FIG. 2 is a perspective view of a string quartet according to the preferred embodiment of the present invention.
Figure 4:
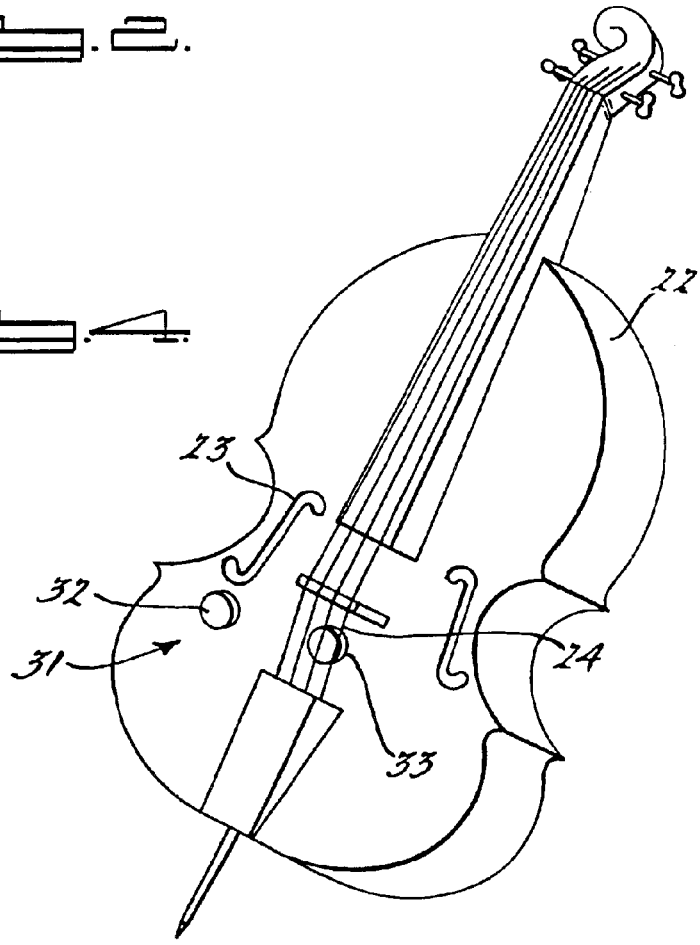
FIG. 4 is a perspective view of a pair of contact transducers as applied to a cello according to the present invention.

Preferably, the ensemble sound pattern emanates from a plurality of instruments, and as shown in FIG. 2, the preferred embodiment simulates a string quartet 21'. It will be appreciated that while it is preferred to simulate a string quartet 21', other instruments such as brass or wind instruments can be simulated without parting from the spirit and scope of the invention. As shown in FIG. 3, the signal generation system 30 preferably includes a plurality of contact recording configurations 31 for converting the vibrations from ensemble 21 into contact recording signals. FIG. 4 demonstrates that each contact recording configuration 31 preferably includes a pair of contact transducers coupled to a corresponding instrument 22. The location of each contact transducer is governed by listening tests and cross-correlation function measurements in different frequency bands at different locations. Specifically, each pair of contact transducers includes a first transducer 32 located below an F-hole 23 of the corresponding instrument 22. The first transducer 32 generates a contact recording signal based on vibrations near the F-hole 23. A second to contact transducer 33 is located under a bridge 24 of the corresponding instrument 22. Similarly, the second transducer 33 generates a contact recording signal based on vibrations near the bridge 24. As will be discussed below, the signals from the transducers 32, 33 are simultaneously recorded to separate channels using sound recording techniques well known in the art. Thus, two channels per instrument are created in the preferred embodiment.

Figure 5:
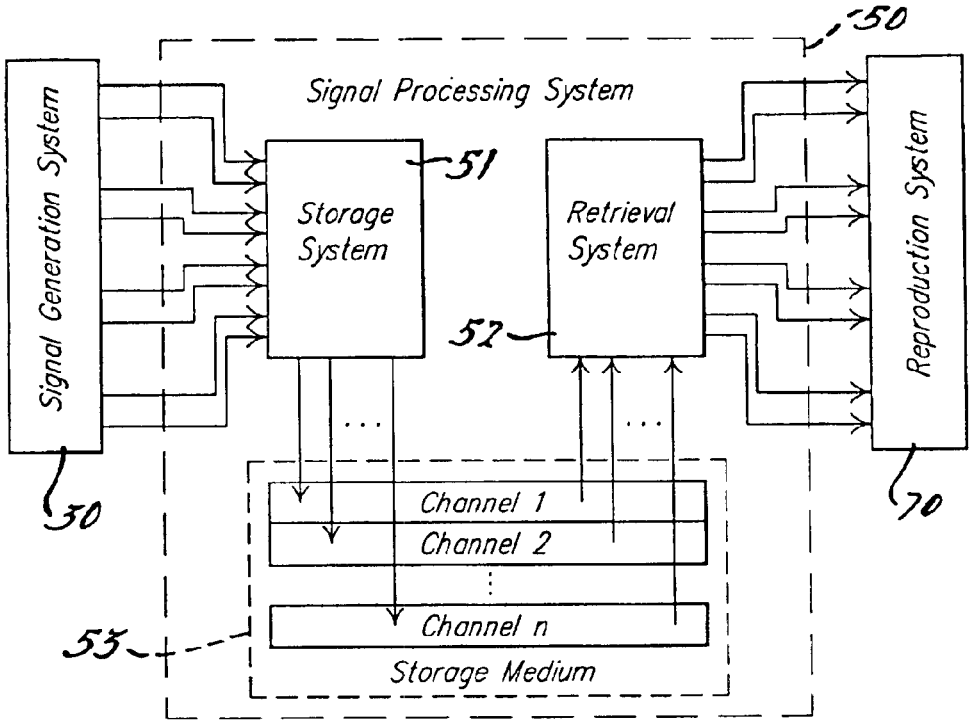
FIG. 5 is a block diagram of a signal processing system according to the present invention.
Figure 6:
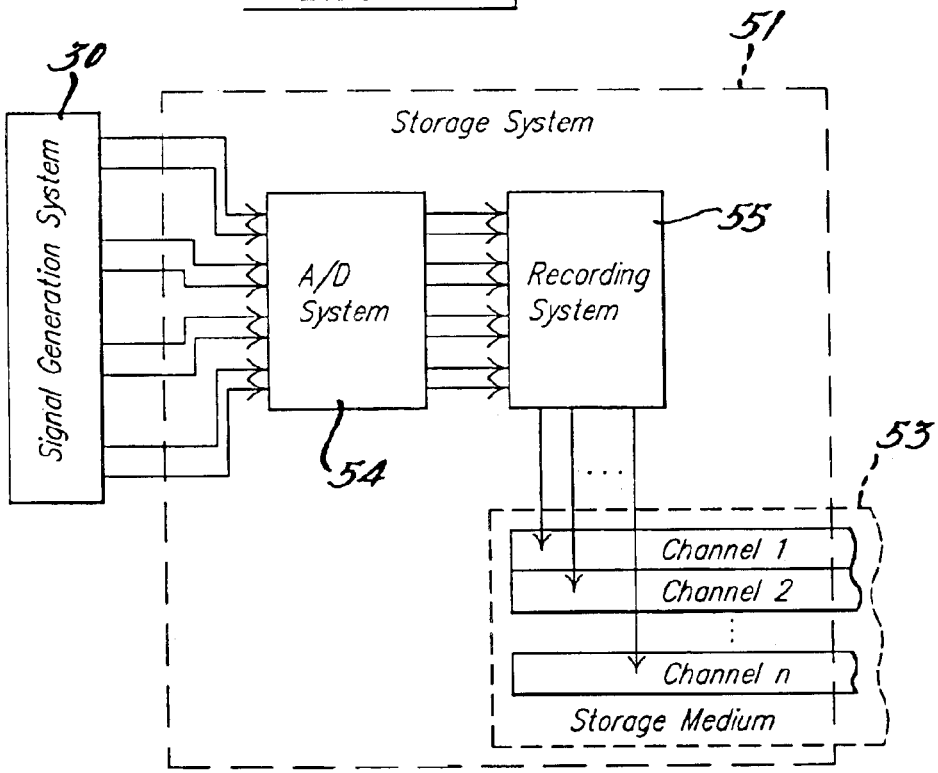
FIG. 6 is a block diagram of a storage system for a signal processing system according to the present invention.
Figure 7:
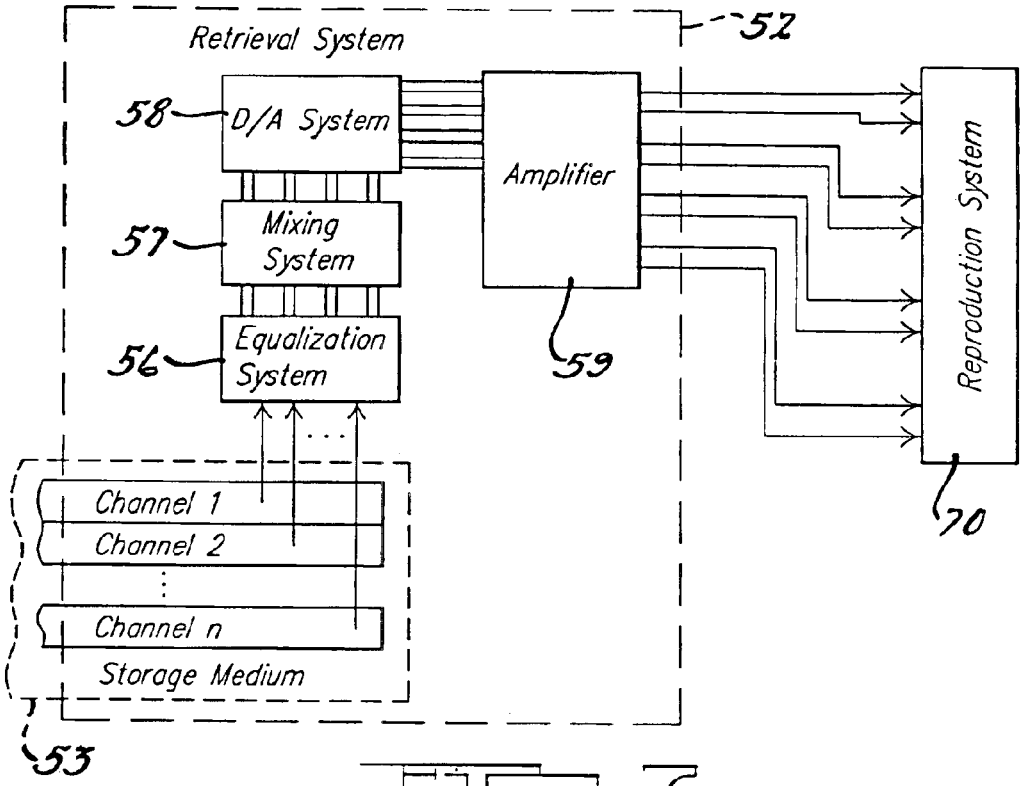
FIG. 7 is a block diagram of a retrieval system for a signal processing system according to the present invention.

Turning now to FIG. 5, the preferred signal processing system 51 is shown in greater detail. The signal processing system 50 includes a storage system 51 for storing the contact recording signals to a storage medium 53 as channelized data. A retrieval system 52 retrieves the channelized data from the storage medium 53. It will be appreciated that storage medium 53 is preferably a computer readable medium such as a CD-ROM or DVD. As shown in FIG. 6, it is preferred that the storage system 51 include an analog to digital conversion system 54 for generating digital recording signals based on the contact recording signals from the signal generation system 30. A recording system 55 generates the channelized data based on the digital recording signals and records the channelized data to the storage medium 53. The signals are therefore maintained on separate channels throughout the simulation process. It will further be appreciated that as shown in FIG. 7, the retrieval system 52 of the signal processing system 50 preferably includes an equalization system 56 for tailoring a frequency response of the channelized data. A mixing system 57 generates intermediate instrument signals based on the channelized data. The preferred retrieval system 52 further includes a digital to analog conversion system 58 for generating final instrument signals based on the intermediate instrument signals. Thus, amplifier 59 can amplify the final instrument signals for transmission to the reproduction system 70.

Figure 8:
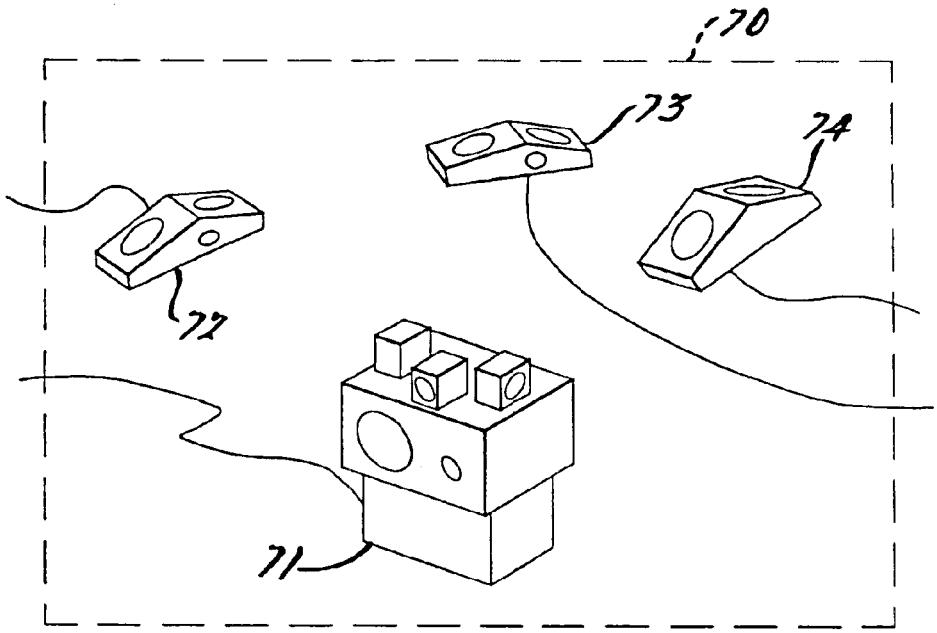
FIG. 8 is a perspective view of a reproduction system according to a preferred embodiment of the present invention.
Figure 9:
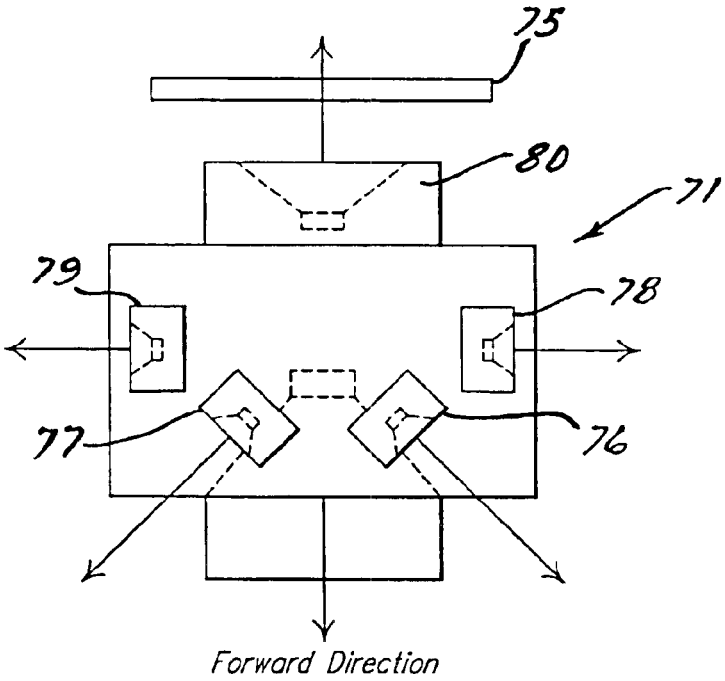
FIG. 9 is a sectional top view of a loudspeaker system according to the present invention.

The reproduction system 70 will now be described in greater detail. FIG. 8 demonstrates that the reproduction system 70A includes a plurality of loudspeaker systems 71, 72, 73 and 74. It is preferred that each loudspeaker system 71, 72, 73 and 74 has an assigned instrument and generates audible sound waves which approximate a frequency dependence of sound wave radiation from front, back and side surfaces of the assigned instrument. As best seen in FIG. 9, the reproduction system 70 may also include a means for simulating musician absorption of the audible sound waves such as absorption panel 75. It can further be seen that each loudspeaker system includes at least one front driver 76 having a predetermined front piston diameter for approximating the frequency dependence of radiation from front and side surfaces of the assigned instrument. FIG. 9 further demonstrates that a second front driver 77 can also be provided. Furthermore, as cost considerations permit, loudspeaker systems can have side drivers 78, 79 to further increase accuracy of the simulation. As will be discussed later, each instrument has an asymmetrical frequency response. This asymmetrical frequency response is essentially an angular dependence of radiation from all surfaces of the instrument. Angular dependence can be matched in its coarse structure and approximated in its fine structure.

It will be appreciated that the simulation system 20 matches the simulation coarse angular dependence to a reference coarse angular dependence by two techniques. First, the frequency dependence of the radiation from front and back surfaces is approximated by using separate loudspeaker drivers. Thus, back driver 80 has a predetermined rear piston diameter for, approximating the frequency dependence of radiation from back and side surfaces of the assigned instrument. Furthermore, front drivers 76, 77 reproduce radiation in the forward direction of the assigned instrument. The second matching technique approximates the polar radiation pattern. The polar pattern on radiation is approximated by using drivers with a piston diameter that reproduces the low-frequency lobe in the forward direction. For example, at an angle of 90 degrees the radiation from a viola is down 3 dB at a frequency of 1000 Hz. According to well-known theories for the radiation of a piston in an infinite baffle, a polar pattern with that characteristic requires a piston diameter of about 22 cm. The use of separate drivers 76, 77, 78, 79, 80 is further improved with the deployment of front and back equalizers (not shown) at the input to each driver 76, 77, 78, 79, 80.

Figure 14:
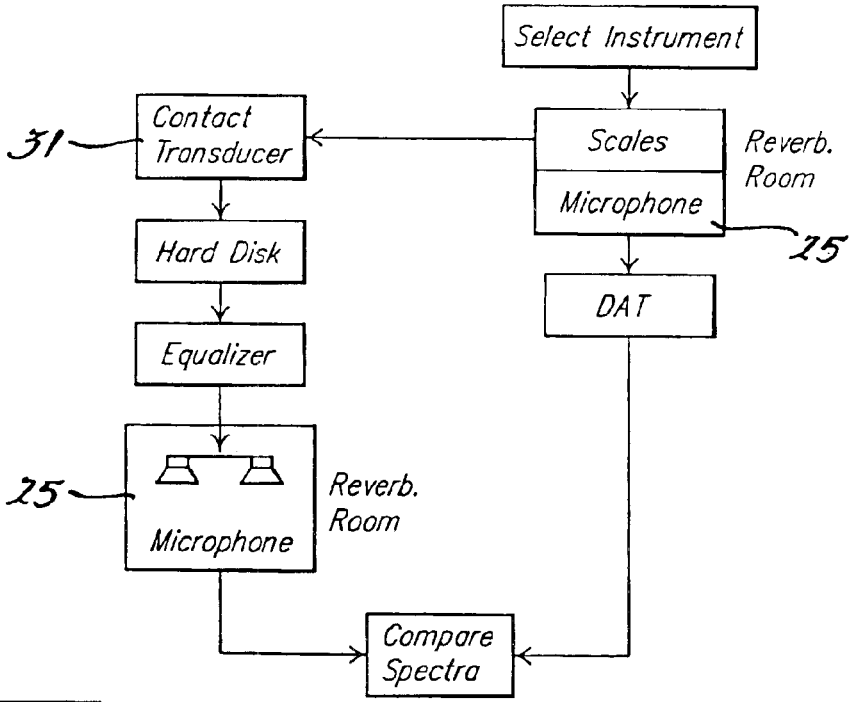
FIG. 14 is a block diagram demonstrating the process of matching overall frequency response according to the present invention.
Figure 11:
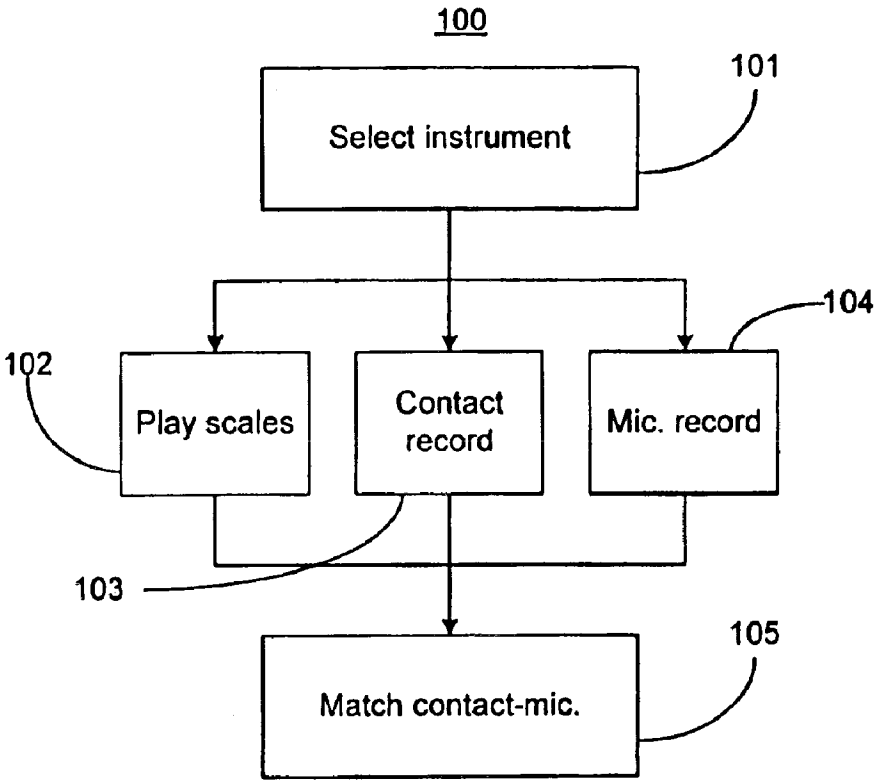
FIG. 11 is a flowchart of a process for matching overall frequency response according to the present invention.
Figure 10:
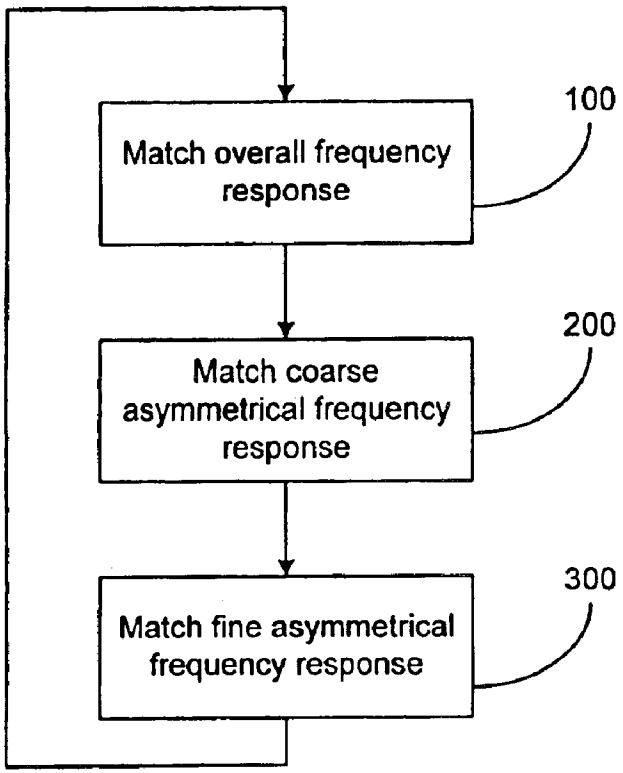
FIG. 10 is a flowchart of a process for tuning a local performance simulation system according to the present invention.

Turning now to FIG. 10, a method for tuning a local performance simulation system to the required frequency responses is shown in greater detail. Specifically, at step 100, the system overall frequency response is matched to a known overall frequency response. The method further includes the step 200 of matching the system coarse asymmetrical frequency response and step 300 of approximating the system fine asymmetrical frequency response. FIG. 11 shows step 100 in greater detail. It can be seen that at step 101 an instrument is selected from the ensemble. The musician then plays scales at step 102, and contact and acoustic microphone recordings are simultaneously made at steps 103 and 104, respectively. At step 105, the equalizer is adjusted so that the overall frequency response of the simulation, measured in one-third-octave bands approximates the overall frequency response of the microphone recording. FIG. 14 demonstrates that recordings are made with contact recording configurations 31 as usual and, using a separate recorder, with acoustical microphones 25. In constructing the listening system, the loudspeakers are adjusted so that when they reproduce the signals from the contact transducers 31, the long-term spectrum measured with the same acoustical microphones 25 and the same reverberant environment matches the original recordings. Perceptually important spectral structures in the real instruments will be captured by the third-octave matching technique.

As noted above, each instrument also has an asymmetrical frequency response which has an angular dependence. With respect to coarse structures, the overall directional frequency response of musical instruments has been measured in anechoic rooms by many workers. For example, Jurgen Meyer has measured the angular dependence of the frequency response for many orchestral instruments including the violin, viola and cello. These responses appear in his 1978 textbook entitled "Acoustics and the Performance of Music".

Figure 12:
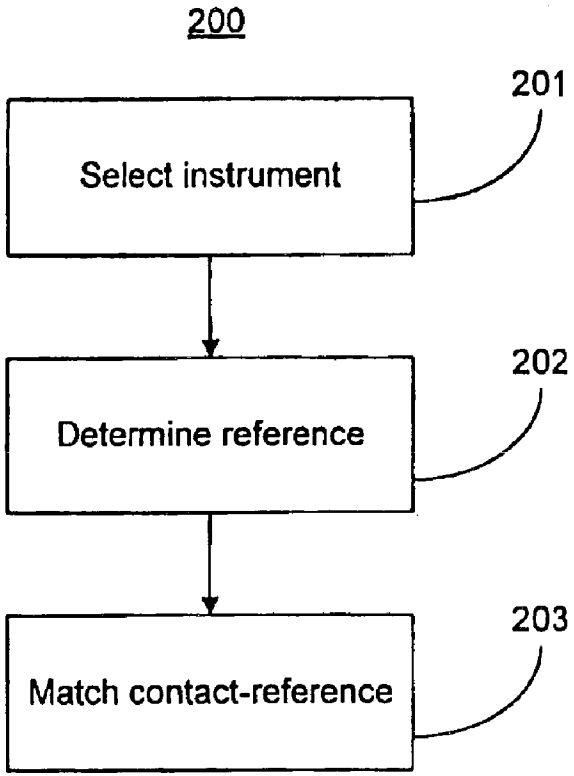
FIG. 12 is a flowchart of a process for matching coarse asymmetrical frequency response according to the present invention.

Turning now to FIG. 12, the process of matching coarse asymmetrical frequency response is shown in greater detail. At step 201, the instrument is selected and at step 202, the reference coarse angular dependence is determined. The reproduction of the contact recording is matched to the reference at step 203 by the loudspeaker design techniques described above.

Figure 13:
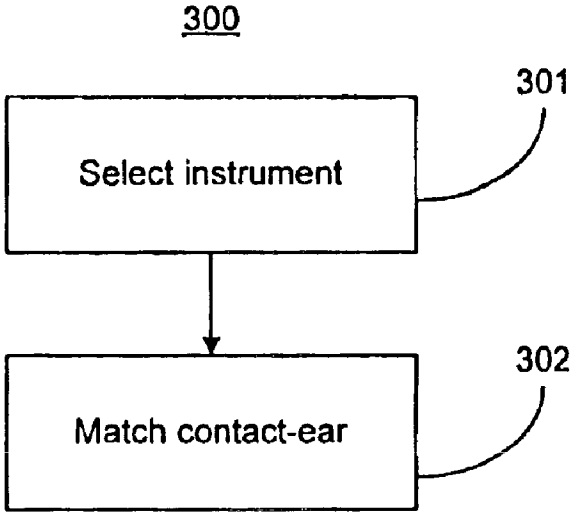
FIG. 13 is a flowchart of a process for matching fine asymmetrical frequency response according to the present invention.

As shown in FIG. 13, the present invention also provides for matching the fine asymmetrical frequency response. The fine structure of the radiation pattern of a musical instrument is complicated. For violins, the fine structure is different from violin to violin. The result of the fine structure is that when the musician plays changing notes, the different high frequency harmonics are radiated in directions that change dramatically. This effect lends interest to the sound of the instrument and the tone is perceived as being more lively. The present invention does not attempt to reproduce the fine structure of any particular instrument. What is thought to be important is simply that some complicated fine structure be present. For each instrument of a stringed quartet, multiple loudspeakers can be used. Each speaker is driven by a weighted mixture of bridge and F-hole signals with possible inversion. The resulting interference pattern leads to the fine structure of the instrument. At this time, the weighting functions and decisions to invert are tuned by ear. Thus, at step 301, the instrument is selected and at step 302, the contact recording reproduction is matched by ear.

There are numerous alternative implementations of the present invention. For bowed string instruments, the individual radiation pattern can be simulated by comb filtering as in existing mono to stereo converters. In this case, it is adequate to record a single channel for each instrument and tight-miking might be used instead of contact pickups. For brass and woodwind instruments, the recordings can be made with mouthpiece pickups. After filtering, these recordings are reproduced through characteristic loudspeakers. Brass instruments use a single piston driver of appropriate size, whereas woodwind instruments require a more complicated design.

It is to be understood that the invention is not limited to the exact construction illustrated and described above, but that various changes and modifications may be made without departing from the spirit and scope of the invention as defined in the following claims.

What is claimed is:

1. A sound reproduction system, comprising:

a first multi-driver speaker system having a first plurality of co-located speakers configured to emit sound in a first plurality of radial directions, thereby approximating a first frequency dependence of radiation from front, back and side surfaces of a first assigned instrument, wherein a front piston diameter and a rear piston diameter are chosen to respectively reproduce a forward and rear frequency dependence and polar radiation pattern of the first assigned instrument; and a second multi-driver speaker system having a second plurality of co-located speakers configured to emit sound in a second plurality; of radial directions, thereby approximating a second frequency dependence of radiation from front, back and side surfaces of a second assigned instrument, wherein a front piston diameter and a rear piston diameter are chosen to respectively reproduce a forward and rear frequency dependence and polar radiation pattern of the second assigned instrument.

2. The system of claim 1, further comprising:

a signal generation system for simultaneously generating contact recording signals based on vibrations from an ensemble, the ensemble producing an audible ensemble sound pattern; and a signal processing system for channelizing the contact recording signals and generating final instrument signals based on the channelized contact recording signals.

3. The system of claim 1 wherein the ensemble includes a plurality of instruments.

4. The system of claim 3 wherein the plurality of instruments includes a string quartet.

5. The system of claim 3 wherein the signal generation system includes a plurality of contact recording configurations.

6. The system of claim 5 wherein each contact recording configuration includes a pair of contact transducers coupled to a corresponding instrument at a location governed by a cross-correlation function as measured in different frequency bands.

7. The system of claim 6 wherein the pair of contact transducers includes:

a first transducer located below an f-hole of the corresponding instrument, the first transducer generating a contact recording signal based on vibrations near the f-hole; and a second transducer located under a bridge of the corresponding instrument, the second transducer generating a contact recording signal based on vibrations near the bridge.

8. The system of claim 1 wherein the signal processing system includes:

a storage system for storing contact recording signals to a storage medium as channelized data; and a retrieval system for retrieving the channelized data from the storage medium.

9. The system of claim 8 wherein the storage system includes:

an analog to digital conversion system for generating digital recording signals based on the contact recording signals; and a recording system for generating the channelized data based on the digital recording signals, the recording system recording the channelized data to the storage medium.

10. The system of claim 9 wherein the retrieval system includes:

an equalization system for tailoring a frequency response of the channelized data;

a mixing system for generating intermediate instrument signals based on the channelized data;

a digital to analog conversion system for generating final instrument signals based on the intermediate instrument signals; and an amplifier for amplifying the final instrument signals.

11. A multi-driver speaker system comprising:

a front speaker having a front piston diameter chosen to reproduce a forward frequency dependence of and polar radiation pattern of a front surface of a particular musical instrument; and a rear speaker having a rear piston diameter chosen to reproduce a rearward frequency dependence of and polar radiation pattern of a rear surface of the particular musical instrument, wherein the front and rear speakers are configured to emit sound in front and rear directions in order to approximate a frequency dependence of radiation from front and rear surfaces of the particular musical instrument.

12. The system of claim 11, further comprising a side speaker having a side piston diameter chosen to reproduce a side frequency dependence of and polar radiation pattern of a side surface of the particular musical instrument, wherein the side surface is configured to emit sound in a side direction relative to the front and rear speakers in order to approximate a frequency dependence of radiation from a side surface of the particular musical instrument.

13. A method of manufacturing a multi-driver speaker system, comprising:

choosing a front speaker to have a front piston diameter adapted to reproduce a forward frequency dependence of and polar radiation pattern of a front surface of a particular musical instrument;

choosing a rear speaker to have a rear piston diameter adapted to reproduce a rearward frequency dependence of and polar radiation pattern of a rear surface of the particular musical instrument; and configuring the front and rear speakers to emit sound in front and rear directions in order to approximate a frequency dependence of radiation from front and rear surfaces of the particular musical instrument.

14. The method of claim 13, further comprising:

choosing a side speaker to have a side piston diameter chosen to: reproduce a side frequency dependence of and polar radiation pattern of a side surface of the particular musical instrument; and configuring the side speaker to emit sound in a side direction relative to the front and rear speakers in order to approximate a frequency dependence of radiation from a side surface of the particular musical instrument.

* * * * *

UNITED STATES PATENT AND TRADEMARK OFFICE

CERTIFICATE OF CORRECTION

PATENT NO. : 6,925,426 B1
APPLICATION NO. : 09/510629
DATED : August 2, 2005
INVENTOR(S) : William M. Hartmann It is certified that error appears in the above-identified patent and that said Letters Patent is hereby corrected as shown below:

Column 4,
Line 11, after "second" delete "to".
Line 48, "70A" should be -- 70 --.

Column 5,
Line 9, "for," should be -- for --.

Column 6,
Line 51, "plurality;" should be -- plurality --.

Column 8,
Line 40, "to:" should be -- to --.

Signed and Sealed this

Twentieth Day of June, 2006

JON W. DUDAS
*Director of the United States Patent and Trademark Office*